United States Patent [19]

Goldfarb et al.

[11] 4,119,315

[45] Oct. 10, 1978

[54] COMPETITIVE ACTION PLAYING GAME WITH ERRATICALLY MOVABLE PLAYING PIECE

[76] Inventors: Adolph E. Goldfarb, 4614 Monarca Dr., Tarzana, Calif. 91356; Erwin Benkoe, 17965 Medley Dr., Encino, Calif. 91316

[21] Appl. No.: 764,006

[22] Filed: Jan. 31, 1977

[51] Int. Cl.[2] ..... A63F 7/06

[52] U.S. Cl. ..... 273/85 F; 273/58 F; 273/119 R

[58] Field of Search ..... 273/85 B, 85 C, 85 E, 273/85 F, 58 F, 119 R, 129 GB

[56] References Cited

U.S. PATENT DOCUMENTS

| | | | |
|---|---|---|---|
| 3,498,613 | 3/1970 | Dreyer | 273/58 F UX |
| 3,811,674 | 5/1974 | Trbovich et al. | 273/85 E |
| 3,912,272 | 10/1975 | Hicks et al. | 273/119 R |

FOREIGN PATENT DOCUMENTS

| | | | |
|---|---|---|---|
| 618,405 | 4/1961 | Canada | 273/85 B |
| 74,723 | 9/1952 | Denmark | 273/85 E |
| 43,885 | 6/1934 | France | 273/58 F |
| 163,535 | 5/1921 | United Kingdom | 273/85 E |
| 676,337 | 7/1952 | United Kingdom | 273/85 E |

*Primary Examiner*—Anton O. Oechsle
*Attorney, Agent, or Firm*—Robert M. Ashen; Robert J. Schaap

[57] ABSTRACT

A competitive action playing game with a shiftable ball-type playing piece. The playing game comprises a game board having a pair of oppositely spaced player ends with a frame peripherally surrounding the game board. The game board is provided with a plurality of rows of playing piece receiving recesses. The rows extend from end to end and there are a plurality of the recesses in each of the rows. A plurality of first and second actuating members are located at the respective first and second player ends with each one of the actuating members associated with a particular one of the rows. An individual first playing piece projecting element is located at each recess in each of the rows and like second projecting elements are located at each recess in each of the rows and the projecting elements in any one row are simultaneously operable by the first or second actuating member associated with that row. When the actuating member for a particular row is depressed, the associated projecting elements will extend upwardly in the recesses of that row so as to engage and propel the playing piece toward the opposed player end. The playing piece is an erratically movable ball with an outer shell. An inner element is freely movable within the outer shell to cause erratic movement of the playing piece and also provides additional weight to keep the playing piece in close proximity to the playing surface when it is propelled.

18 Claims, 7 Drawing Figures

COMPETITIVE ACTION PLAYING GAME WITH ERRATICALLY MOVABLE PLAYING PIECE

BACKGROUND OF THE INVENTION

This invention relates in general to certain new and useful improvements in competitive action playing games and, more particularly, to competitive action playing games which utilize a shiftable ball-type playing piece which permits erratic movement on a playing board, and which also utilizes uniquely designed actuating members for propelling the playing piece.

There are presently a large number of prior art playing games in which a player at one of the pair of opposed player ends of a playing board attempt to actuate various forms of actuating members to initiate the movement of a playing piece toward the other opposed player's end. These various forms of playing games typically utilize goal areas at each of the opposed player ends and are operable in such manner that each of the players attempt to actuate a means for propelling a playing piece, such as a playing ball, toward the opposed player's end. When one of the players achieves movement of the playing piece into the opposed player's end, a score is achieved.

One form of prior art playing game in the form of a simulated basketball game employed a playing board having a plurality of recessed portions thereon with apertures. Striker elements were located to extend through these apertures in order to engage a playing piece which may land in the recesses. An individual actuating member at each of the opposed player ends of the game board, was provided for each striker element. Moreover, the playing board had a pair of upstanding baskets with the object of the opposed players to attempt to "kick" the playing ball by means of the striker elements into the opponent's basket. Moreover, some of the striker elements on this game board were larger than the others in order to compensate for distance from the baskets. The striker elements were mounted on rods for pivotal movement. Thus, each of the striker elements were pivoted upwardly and forwardly in order to engage and propel the playing ball.

One of the primary disadvantages of this prior art form of game is that the playing ball would often tend to be propelled off of the playing board, thereby interrupting the play and with the necessity of the players to retrieve the playing ball. Moreover, it was necessary for each of the players to select and actuate the appropriate individual actuating member or button at his playing end to thereby shift the proper striker element in order to engage and propel the playing ball. This large number of actuating members for operation added a degree of confusion and difficulty in playing the game. In addition, inasmuch as the striker elements were pivotally mounted with respect to the recesses, rather complex structure was required in order to actuate these striker elements.

There has also been a commercially available, erractically moving playing ball known under the commercial designation as "Crazy Ball". This ball included a weight which was on the inside of the outer ball or shell in order to provide erratic movement in air. This ball was not designed for use on a playing board, but was designed to provide the erratic movement between two players throwing and catching the ball.

The present invention provides a unique competitive action playing game which obviates many of the problems of the type mentioned above which were inherent with these prior art forms of playing games. The playing game of the present invention relies upon a playing board having a plurality of rows of recesses therein with striker elements located beneath the recesses in each of the rows. One actuating member is provided for actuating each of the striker elements associated with the recesses in that row. Thus, striker elements for each of the recesses in a row can be actuated by one of the opposing players by actuation of the actuating member for that row and second striker elements associated with each of the recesses in a row can be actuated by the other opposing player by actuation of the second actuating member for that row. In this way, as the playing ball tends to move into the lower portion of the recess, the two opposing players will attempt to actuate the associated striker elements in order to propel the ball toward the opponent's goal area. Moreover, the playing piece of the present invention employs a hollow outer shell with an inner element freely movable in the outer shell in order to provide an erratic movement on the game board and to also maintain the ball in close proximity to the game board as it is propelled. The ball tends to move sideways from row to row as well as in the direction of the rows. This erratic movement lends to an increased excitement in play in that the players can try to anticipate the row to which the ball will move and come to rest and quickly move their hands to operate the actuating member for that row.

OBJECTS OF THE INVENTION

It is, therefore, a primary object of the present invention to provide a playing game having a game board with a plurality of recesses with striker elements located at each of the recesses and operated by unique actuating means at each of a pair of opposed player ends.

It is another object of the present invention to provide a playing game of the type stated which utilizes an erratically movable playing ball and which moves across the game board in close proximity to the game board when propelled.

It is a further object of the present invention to provide a playing game of the type stated which employs rows of recesses and first and second striker elements in the recesses where each first striker element in one row is operated by an individual actuating member at one player end and each second striker element in a row is operated by an individual actuating member at the other player end.

It is also an object of the present invention to provide a playing game of the type stated which is relatively durable in its construction and which can be manufactured at a relatively low unit cost.

It is an additional object of the present invention to provide a toy playing game of the type stated which permits opponent players to exercise skill and strategy and which also involves an element of chance.

With the above and other objects in view, our invention resides in the novel features of form, construction, arrangement and combination of parts presently described and pointed out in the claims.

BRIEF SUMMARY OF THE DISCLOSURE

A competitive action playing game playable with a shiftable ball-type playing piece. The game is comprised of a game board with a game playing surface extending between a pair of opposed player ends. The game board is also provided with a plurality of rows of playing piece receiving recesses. The rows extend from end to end of the board. A plurality of such recesses are formed in each of the row. Moreover, the recesses open into elongate slots at their bottom portions.

The term "recess" as used herein represents a depression in the game board and where each of the depressions are generally square-shaped formed by sloping walls which open at the elongate slots.

The game board also includes a plurality of first actuating members at the first of the opposed player ends with one first actuating member provided for each row. In like manner, a plurality of second actuating members are located at the second of the opposed player ends, again, with one second actuating member for each such row. A first playing piece projecting element (or striker element) is located in the slot of each recess in each of the rows. The first projecting elements in each row are simultaneously operable by one of the first actuating members associated with such rows, such that when the first actuating member in the form of a lever is depressed each of the first projecting elements will simultaneously extend through the slots to engage a playing piece which may be in a recess of that row to propel the play piece toward the second player end. In like manner, a plurality of second playing piece projecting elements are located at each recess in each of the rows and these second projecting elements in each row are simultaneously operable by a particular actuating member associated with that row to propel the play piece toward the first player end.

A unique connecting means, (often referred to herein as an "actuating bar" or "connecting bar") is provided for connecting the first projecting elements in each of the rows to the first actuating members associated with each row. In this way, when the actuating member is pushed downwardly, the projecting elements will extend upwardly through the recesses in the rows to engage and propel the playing piece across the playing board. The same action occurs by means of a second connecting means associated with the second projecting elements.

The connecting means are generally in the form of longitudinally extending bars associated with each of the rows. Thus, each row will have a first connecting bar and a second connecting bar in closely spaced relationship so that each of the bars shift in the opposite directions when the actuating members associated therewith are actuated.

The recesses are regularly spaced across the game board and, moreover, the recesses in each row are regularly spaced. In addition, the recesses are generally provided with inwardly and downwardly sloping walls, somewhat triangular in shape, and lead into the slots where the projecting elements are located. A biasing means, which may be in the form of a rubber band, is located at each of the player ends to bias the actuating members and the connecting means to their unactuated position. In addition, the projecting elements are preferably located on the respective connecting bars. A camming means is provided to bias the connecting means and the projecting elements both upwardly and toward the opposite playing end.

One of the unique aspects of the present invention is that the invention utilizes a ball-type playing piece comprised of a hollow generally sperical outer shell with an inner element freely movable within the outer shell to create a somewhat erratic movement of the playing piece on the playing board. In a preferred aspect the outer shell may be of a material such as plastic and the inner element which may be formed of a material having a greater density, such as metal. In addition, this construction enables the playing piece to be propelled across the playing board, not only in an erratic movement, but retains the playing piece in close proximity to the surface of the playing board.

The playing ball has a total weight relative to the amount of force applied to the ball by the movable projecting elements such that the playing piece will be shifted only for a limited distance and also within close proximity to the playing board. In this respect, the playing board is also provided with upstanding frame sections along the longitudinal margins thereof between the opposed player ends so that the ball is always retained on the playing board.

By virtue of the inner element in the outer spherical shell, the playing piece will have an erratic movement on the playing board. Thus, the ball moves from row to row (i.e. side to side) as well as from end to end. Therefore, the game not only involves an element of chance, but an element of skill in that the player must attempt to anticipate in which row the ball will come to rest and react quickly as the ball moves erratically to the side from row to row.

As soon as the playing ball moves into one of the recesses in a particular row, each of the players must immediately shift their fingers to the actuating member in that row in order to actuate the actuating member. In doing so, a player may hit the wrong actuating member, in which case, the other opposing player will have an opportunity to shift the playing ball.

BRIEF DESCRIPTION OF THE DRAWINGS

Figure 1:
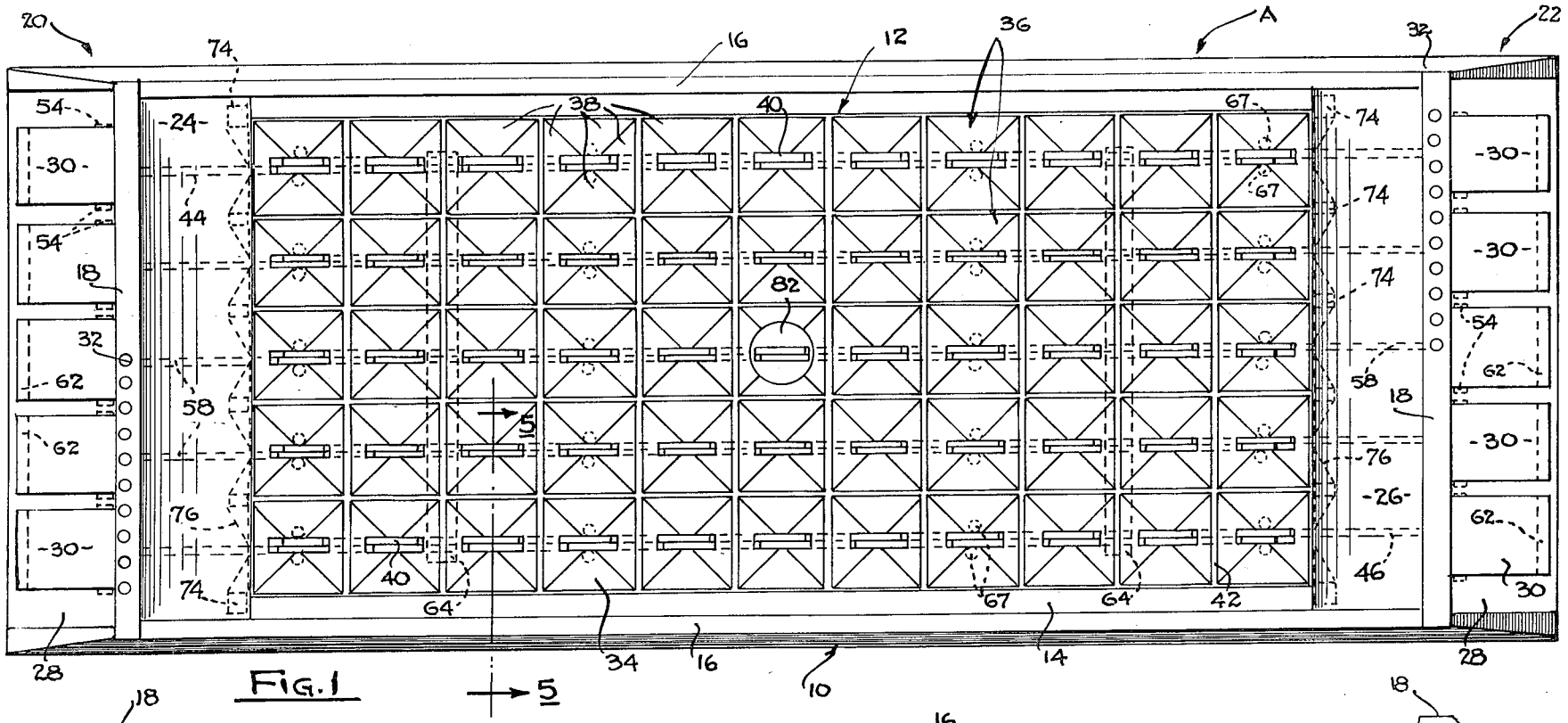
Figure 2:
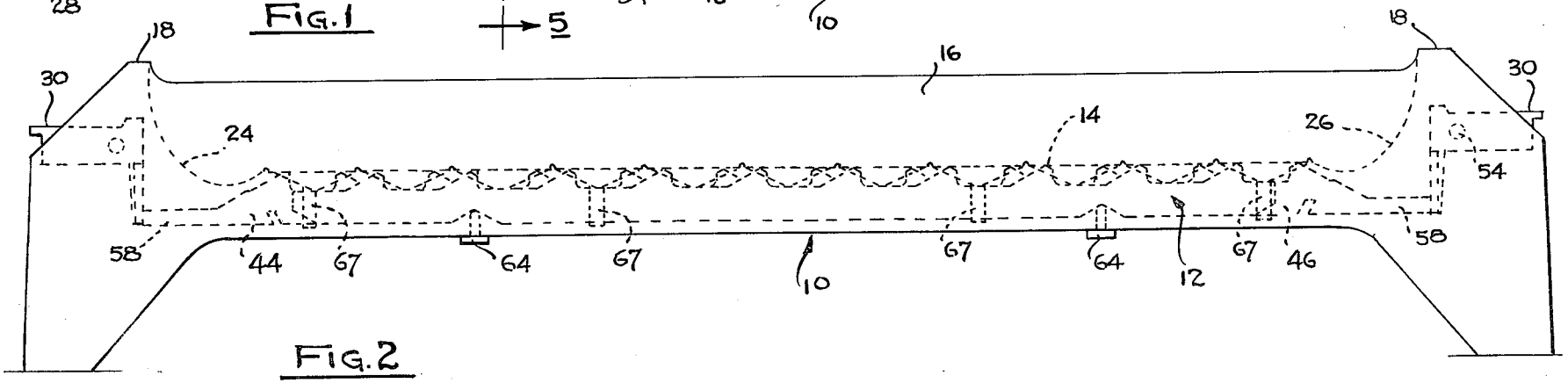
Figure 3:
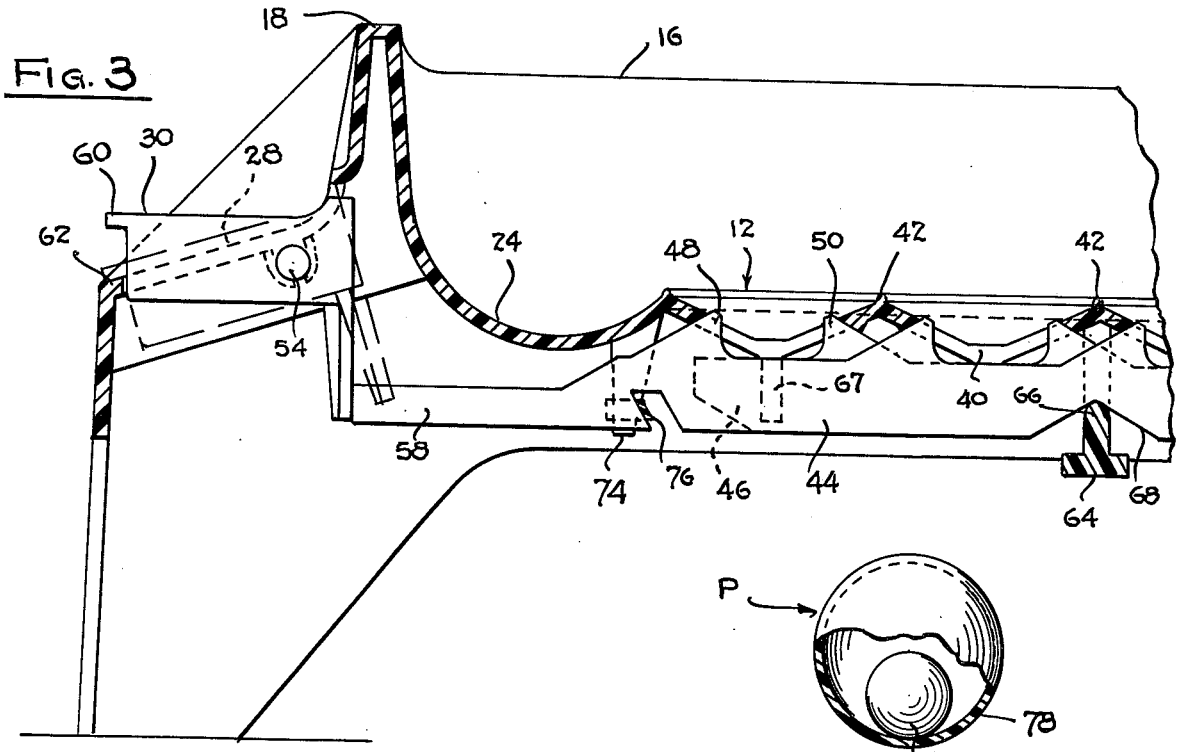
Figure 7:
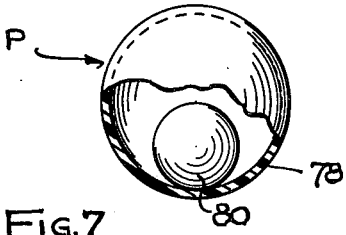
Figure 4:
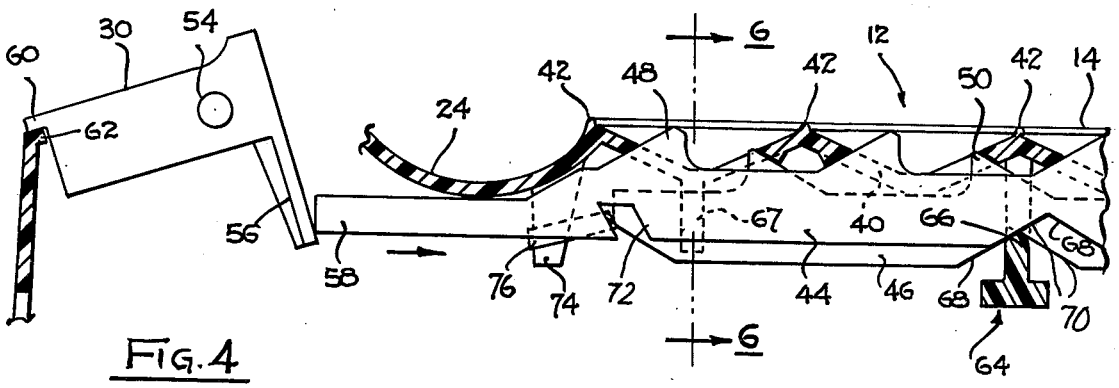
Figure 5:
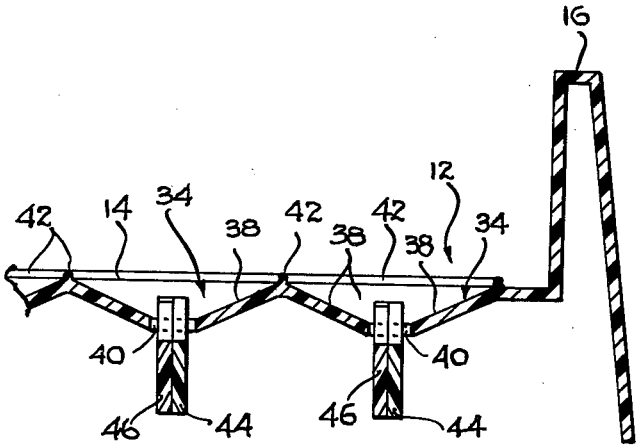
Figure 6:
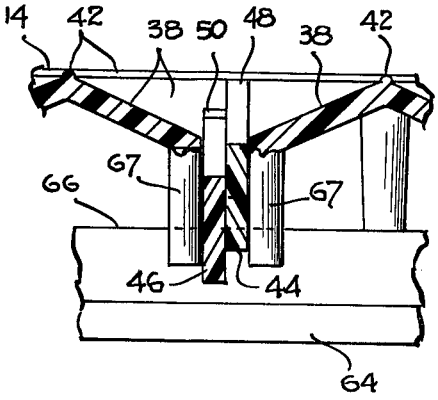

Having thus described the invention in general terms, reference will now be made to the accompanying drawings in which:

FIG. 1 is a top-plan view of a playing game constructed in accordance with and embodying the present invention;

FIG. 2 is a side elevational view, having a portion thereof shown in phantom lines, of the playing game of FIG. 1;

FIG. 3 is an enlarged fragmentary vertical sectional view showing one of the player ends and with one of the actuating members in the unactuated position;

FIG. 4 is an enlarged fragmentary vertical sectional view, similar to FIG. 3, and showing the actuating member in the actuated position;

FIG. 5 is a fragmentary vertical sectional view, taken along line 5—5 of FIG. 1, and showing the construction of the recesses in the game board of the present invention;

FIG. 6 is a vertical sectional view, taken along line 6—6 of FIG. 4, and showing a portion of the actuating rod construction forming part of the playing game of the present invention; and FIG. 7 is a side elevational view, partially broken away and in section, and showing the playing piece construction in accordance with the present invention.

DETAILED DESCRIPTION OF THE PREFERRED EMBODIMENT

Referring now in more detail and by reference characters to the drawings which illustrate a preferred embodiment of the present invention, A designates a playing game comprised of a frame 10 with a game playing board 12 presenting a playing surface 14. A pair of longitudinally extending and upstanding rails 16 form part of the frame 10 and extend along the longitudinal margins of the game board 12. Moreover, the frame 10 includes a pair of transversely extending rails 18 which connect with the longitudinal rails 16, in the manner as illustrated in FIG. 1 of the drawings.

The game board is provided with first and second opposed player ends designated respectively as 20 and 22, in the manner as illustrated in FIGS. 1 and 2. The game board 12 is provided with a recessed goal area 24 at the player end 20 and the game board 12 is similarly provided with a recessed goal area 26 at the player end 22, in order to receive a playing piece P, as hereinafter described in more detail.

At each of the player ends 20 and 22, the game board 12 is provided with extended portions 28 for accommodating individual actuating buttons or levers 30. Moreover, the transverse rails may be provided with score-keeping means, as for example, a plurality of depressible score pushbuttons 32, although any form of conventional score-keeping means may be provided in connection with the present invention.

The various components forming part of the device A, with the possible exception of portions of the playing piece (hereinafter described) can all be constructed of a number of well-known plastic materials including for example, polyethylene, polystyrene, polybutadiene, a number of known vinyladiene copolymers and the like. These components may be formed in any of a number of known plastic forming techniques including blow molding, injection molding, thermo-forming and the like. However, it can also be observed that many of the components forming part of the device A as well as the playing piece P, for that matter, could be formed of other materials including light weight metals, such as aluminum or the like. Moreover, these various components can be formed of reinforced plastic materials as for example, resin matrix reinforced plastics including, e.g., thermosetting and thermoplastic resins along with various fiberous materials such as glass, boron, carbon or the like. The particular materials used in the construction of these components will be predicated upon necessary strength requirements and desired durability as well as manufacturing costs.

The major surface of the game board 12, between the two goal areas 24 and 26, is provided with a plurality of recesses 34 located in a plurality of transversely spaced rows 36. In the embodiment as illustrated, five individual transversely spaced rows 36 of recesses 34 have been illustrated with eleven recesses in each row. However, it should be apparent that any number of rows and any number of recesses in each row could be employed in accordance with the present invention.

By further reference to FIG. 5, it can be observed that the recesses 34 are integrally formed in the game board by four rectangularly located, downwardly inclined and triangularly shaped walls 38 which lead into an elongated slot 40 formed within the bottom portion of each of the recesses. Moreover, it can be observed that each of the recesses in a particular row are very closely spaced next to each other and are separated by small upstanding rims 42 which surround each recess and which are substantially smaller than the playing piece P. In this way, the playing piece P will always roll into any of the recesses in a particular row or in a next adjacent row. In this same respect, it can be observed that each of the individual rows 36 are located in closely spaced relationship to each other and separated by the upstanding rims. In accordance with this construction, it can be observed that the thickness of the rims 42 is substantially less than the overall size of the playing piece P so that a playing piece will always roll into one of the recesses.

A first individual actuating bar 44, or so-called "connecting bar", is located under each of the individual rows 36 and is adapted for shiftable movement thereunder. Thus, five individual actuating levers or pushbuttons 30 are provided at the first player end 20 and, accordingly, five individual actuating bars would be provided for each of the five rows as illustrated. In like manner, an individual second actuating bar 46, or so-called "connecting bar", is also located under each of the individual rows 36 in closely spaced relationship to the first of the actuating bars. Again, five such second actuating bars are illustrated, with each one being located to be contacted to an individual one of the actuating levers 30 at the second player end 22.

The first actuating bars 44 are integrally provided with first upstanding playing ball projecting elements, or so-called "strikers" or "striker elements" 48. An individual striker 48 is located on each of the actuating bars 44 in the position of each of the slots 40 in each row. In like manner, the second actuating bars 46 are similarly provided with second upstanding ball projecting elements, or so-called "strikers", 50 and, again, an individual striker 50 is located at each such slot 40. By reference to FIGS. 3–5 and 6, it can be observed that the strikers 48, which are actuated by the actuating levers 30, are located at the left-hand end of each of the individual slots 40, and the strikers 50, associated with the second actuating rods 46, are located at the right-hand end of each of the individual slots 40. The first strikers 48 are capable of shifting toward the second player end 22 upon actuation of any of the actuating levers 30 and, in like manner, the second strikers 50 are capable of being shifted within the slots 40 toward the first player end 20 upon actuation of any of the actuating levers 30 at the second player end 22.

Each of the individual actuating levers 30 at each of the opposed player ends 20 and 22 are pivotally mounted on retaining pins 54 which are mounted within the transverse rails 18. Thus, each of the individual actuating levers 30 can be operated independently of any of the other actuating levers. Moreover, the actuating levers 30 are each provided with a downwardly struck flange 56 which engages an extended end 58 on each of the actuating bars 44 and 46. At its other end, each of the actuating levers 30 is provided with an outwardly struck, horizontally extending flange 60 which engage a tab 62 extending upwardly from the extended portions 28, to thereby limit the downwardly movement of the actuating levers 30.

In accordance with the above construction, it can be observed that as any one of the actuating levers 30 are pushed downwardly to the actuated position, as illustrated in FIG. 4, the actuating bar 44 or 46 associated with that lever will be urged toward the opposite player end. Thus, when an actuating lever 30 on the left-hand player end 20 is pushed downwardly, the associated actuating bar 44 will be shifted to the right. As this occurs, the strikers 48 on that actuating bar 44 will be projected forwardly within the slots 40 in that row of recesses 34. In like manner, when the player at the right-hand playing end 22 pushes downwardly on an actuating lever 30, the actuating bar 46 associated with that lever will also be shifted to the left carrying therewith the strikers 50.

Mounted on the underside of the playing board 12 are a pair of longitudinally spaced transversely extending camming elements 64 which have upstanding camming ridges 66. The actuating rods 44 and 46 are suitably retained beneath the playing board 12 and adapted for slidable movement with respect thereto by means of these spaced apart transversely extending camming elements as illustrated in FIGS. 3, 4 and 6 and as also described hereinafter.

Moreover, the actuating bars are retained against transverse movement by a plurality of longitudinally spaced pins 67 (FIG. 6) extending downwardly from the underside of the playing board. It can also be observed that the pins 67 are located on the exterior surfaces of the pair of closely spaced apart actuating bars 44 and 46.

The camming ridges 66 cooperate with a pair of longitudinally spaced, transversely extending inverted V-shaped notches 68 on the underside of each of the actuating bars 44 and 46, in the manner as illustrated in FIGS. 3 and 4. These inverted V-shaped notches 68 present camming surfaces 70 which are capable of riding on the upper portion of the camming ridges 66. It can be observed that as the actuating bar 44 is shifted forwardly to the right, reference being made to FIGS. 3 and 4, the actuating bar will also shift upwardly as the camming surface 70 rides on the camming ridge 66. Thus, the strikers 48 on the actuating bar 44 will also be shifted upwardly in the slots 40 and into the recesses 34. It can also be observed that the actuating rods 46 operate in like manner with the upstanding camming ridges 66, so as to cause an upward and forward movement of the actuating bars 46.

In accordance with the above outlined construction, it can be observed that as any one of the actuating levers 30 is pressed downwardly, the actuating bars 44 or 46 will be shifted toward the other of the player ends. As this occurs, the strikers 48 and 50 will be shifted within the elongated slots 40 in a horizontal plane, and will also be simultaneously shifted upwardly. In this way, the strikers can provide a horizontal vector force and a vertical vector force to the playing ball P in an attempt to move the playing ball P toward the opponent's goal area.

Each of the actuating bars 44 and 46 are provided with somewhat rearwardly and upwardly projected notches 72 near their rearward ends, that is in proximity to the associated goal areas 24 and 26, respectively. In like manner, the playing board 12 is provided with a plurality of transversely spaced apart downwardly extending tabs 74 at each of the opposite ends of the playing board, also in proximity to the goal areas, in the manner as illustrated in FIGS. 3 and 4. A rubber band 76 which serves as a biasing return element, is located within the notches 72 of each of the first actuating bars 44 and trained around the tabs 74 at the left-hand player's end 20. In like manner, a similar rubber band 76 (not shown) is trained around similar tabs and notches 72 at the opposite player end 22. In this way, it can be observed that as the actuating bar 44 is pushed forwardly, the rubber band 76 will bias the actuating bar 44 to its initial position, upon release of the associated actuating lever 30. Again, the second actuating bars 46 and the associated actuating lever 30 operate in like manner. In this respect, it should be observed that any form of biasing means could be employed in connection with the present invention.

The playing ball P comprises an outer generally spherically shaped shell 78 which may be formed of a relatively rigid plastic or other suitable material. Located within the outer shell 78 is a freely movable inner element 80 which may be solid in its construction. The inner element has a mass sufficient to provide an erratic movement to the ball. The inner element may have a weight equal to, greater than, or even less than the shell. Nevertheless, the element 80, in a preferred aspect, may be formed of a material having a higher density than the outer cylindrically shaped shell 78, e.g. a small steel ball. For purposes of construction, the outer shell 78 could be formed in two half sections which are then secured together after inserting the ball 80.

This playing ball P is uniquely designed so that it provides somewhat of an erratic movement on the playing surface 14. In this respect, the playing ball P is properly sized, at least with respect to the sizes of the recesses 34, and the dimension of the upstanding rims 42 extending between each of the recesses. When the playing ball P is propelled by means of one of the strikers 48 or 50, it will have somewhat of an erratic movement due to the nature of the playing board, and, more particularly, due to the fact that the steel ball 80 is freely movable inside of the outer cylindrical shell 78. In addition, the steel ball 80 enables the playing piece to be propelled across the playing board with somewhat of a limited movement and, also, keeps the playing piece in close proximity to the playing board. In the preferred aspect, the steel ball 80 should have sufficient weight so that the playing piece, when propelled, will move only about three to five recesses across the playing board, in the longitudinal dimension. For this purpose, the playing ball should also have a relatively large size, such that it has a size at least about as large as the recesses 34.

In order to play the game of the present invention, one or more players are located at each of the opposed player ends. The playing ball P is initially located in the center of the playing board, that is in the centermost recess in the playing board, designated by reference numeral 82 in FIG. 1. The players will thereupon each depress the actuating lever 30 in the center row in order to move the playing ball P. The player who first engages the playing ball by pushing down on the actuating lever and causing the striker associated with the actuating bar shifted by that lever will cause movement of the playing ball toward the opposed player end.

As the ball is moving across the playing surface, it will tend to always move into one of the recesses. However, due to the erratic movement of the playing ball, and due to the fact that it may land on one of the rims 42, the playing piece can move into either of two recesses in a row or in recesses in either of two adjacent rows. In this way, the players must carefully and quickly select the proper actuating lever 30 in order to engage the playing ball as it approaches a particular recess and a particular row or recesses. Again, the two players will attempt to move the ball toward the opposing player's goal area. The player who first succeeds in moving the playing ball P toward the opponent's goal area will be the winner of the game.

It should be observed in accordance with the present invention that this mode of play is only one form of play which could be utilized in accordance with the game of the present invention. Various other forms of play with slight modifications of the playing board could be achieved.

Thus, there has been illustrated and described a unique and novel playing game which permits one or more players to move an erratically movable playing piece in conformity with a uniquely designed playing surface to an opponent's game area, and which therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention, which is limited only by the following claims.

Having thus described our invention what we desire to claim and secure by letters patent is:

1. A competitive action playing game playable with a shiftable ball-type playing piece, said playing game comprising:

(a) a game board having a playing surface extending between a pair of opposed player ends, said game board also having a plurality of longitudinally extending rows of playing piece receiving depressions extending from end to end across said playing surface with a plurality of depressions in each such row, each of said depressions being formed by at least one inwardly sloping wall which opens into an opening at the lower end of each depression, each of the depressions in each of said rows being spaced from the next adjacent depression in the same row by substantially the same distance as an adjacent depression in a next adjacent row of depressions, the depressions in each of said rows being substantially aligned with the same depressions in such rows and the depressions in each row being substantially aligned with the depressions in the next adjacent row, the upper portion of an inclined wall in one depression being spaced from the upper portion of an inclined wall in the next adjacent depression in the same row by a distance which is substantially less than the overall dimension of each depression in the longitudinal direction, the upper portion of an inclined wall in one depression being spaced from the upper portion of an inclined wall in the next adjacent depression in the next adjacent row by a distance substantially less than the overall transverse dimension of each depression, (b) a plurality of first actuating members at the first of the opposed player ends with one first actuating member for each row, (c) a plurality of second actuating members at the second of the opposed player ends with one second actuating member for each such row, (d) an individual first movable playing piece projecting element located at each depression in each of the rows, (e) an individual second movable playing piece projecting element located at each depression in each of the rows, (f) an individual first longitudinally extending connecting means for each row operatively connecting all of the first projecting elements in such row to an individual first actuating member associated with such row, said first projecting elements in each row normally lying below said playing surface, said first projecting elements in each row being operatively connected to said first connecting means for each such row so that the first projecting elements in such row will generally simultaneously extend upwardly through the openings in the associated depressions and longitudinally toward the second player end upon actuation of said individual first actuating member to engage and propel a ball-type playing piece initially longitudinally across the playing board, said first projecting elements being shiftable to propel said ball-type playing piece generally and at least initially toward the second player end, and (g) an individual second connecting means for each row operatively connecting all of the second projecting elements in such row to an individual second actuating member associated with each row, said second projecting elements in each row normally lying below said playing surface, said second projecting elements in each row being operatively connected to said second connecting means for each such row so that the second projecting elements in such row will generally simultaneously extend upwardly through the openings in the associated depressions and longitudinally toward the first player end upon actuation of said individual second actuating member to engage and propel a ball-type playing piece initially longitudinally across the playing board, said second projecting elements being shiftable to propel said ball-type playing piece generally initially toward the first player end, said first and second projecting elements being disposed in side-by-side relationship at each depression in each row, (h) said playing surface being substantially entirely formed by said depressions, so that such ball-type playing piece will alwauys roll into a depression in a particular row requiring the players to anticipate the row into which said playing piece will roll and select and actuate the proper actuating member.

2. The playing game of claim 1 further characterized in that the first connecting means comprises a first longitudinally extending bar associated with each row and the second connecting means comprises a second longitudinally extending bar associated with each row so that the first and second connecting bars for each row are disposed in substantially side-by-side relationship.

3. The playing game of claim 1 further including a ball-type playing piece which is comprised of a hollow outer generally sperical shell and an inner element freely movable within said outer shell to thereby limit the movement of said playing piece and maintain the playing piece in proximity to the playing surface during movement thereof, said freely movable inner element also creating a somewhat erratic movement of said playing piece on said playing board which initially may be longitudinal and which movement may quickly change to a direction which may have a transverse vector component.

4. The playing game of claim 1 further characterized in that a separate biasing means is located at each of said playing ends to bias said first and second actuating members to each of their unactuated positions.

5. The playing game of claim 1 further characterized in that said first and second projecting elements are located on the respective first and second connecting means, and camming means is provided to bias said connecting means and the projecting elements both upwardly and toward the opposite playing end.

6. The playing game of claim 1 further characterized in that said openings are elongate slots which are generally rectangular in shape and have a length in the longitudinal direction between said two opposed player ends greater than width.

7. A competitive action playing game playable with a shiftable ball-type playing piece, said playing game comprising:

(a) a game board having a playing surface that extends between a pair of opposed player ends and has side edges, said game board also having a plurality of rows of playing piece receiving depressions extending between the opposed player ends with a plurality of depressions in each such row, said game board having at least one downwardly inclined wall surface forming each depression in each row, said playing surface being substantially entirely formed of said depressions and with the inclined wall surface forming each depression in each row being sufficiently closely spaced relative to each other and the inclined wall surface forming the depressions in each row being sufficiently closely spaced to the inclined wall surface forming the depressions in the next adjacent rows relative to the size of a ball-type playing piece so that said ball-type playing piece will always move along the inclined wall surface forming a depression into a depression, (b) retaining means extending upwardly from the side edges of said game board, (c) a plurality of first actuating members at the first of said opposed player ends with one first actuating member for each row and a plurality second actuating members at the second of said opposed player ends with one second actuating member for each such row, (d) individual first playing piece projecting element located at each depression in each of the rows and being operable by the first actuating member associated with that row to move and project through openings at the lower ends of the depressions to engage and initially propel a playing piece toward the second of the player ends, said first projecting elements in each row normally lying below the upper ends of the associated depressions said first projecting elements in each row being operatively connected to said first actuating member for each such row so that the first projecting elements in such row will generally simultaneously extend upwardly through the associated openings in the depressions and longitudinally toward the second player end upon actuation of said individual first actuating member to engage and propel a ball-type playing piece initially longitudinally across the playing board, (e) an individual second playing piece projecting element located at each depression in each of the rows and operable by the second actuating member associated with that row to move and project through openings at the lower ends of the depressions to engage and initially propel a playing piece toward the first of said player ends, said second projecting elements in each row normally lying below the upper ends of the associated depressions, said second projecting elements in each row being operatively connected to said second actuating member for each such row so that the second projecting elements in such row will generally simultaneously extend upwardly through the opening in the association depressions and longitudinally toward the first player end upon actuation of said individual second actuating member to engage and propel a ball-type playing piece initially longitudinally across the playing board, said second projecting elements being shiftable to propel said ball-type playing piece generally initially toward the first player end, and (f) said ball-type playing piece being comprised of a hollow outer generally spherical shell and an inner element which is freely movable within said outer shell to thereby create a somewhat erratic movement of said playing piece on said playing board, which initially may be longitudinal and which movement may change quickly to a direction which may have a transverse vector component so that the players cannot easily predict the path of movement of the playing piece, said playing piece having a weight relative to the force imposed by the projecting elements in moving the playing piece so that the movement of the playing piece is limited and so that the playing piece is maintained in proximity to said playing surface during movement thereof, the close spacing of the inclined wall surface forming the depressions in adjacent rows being sufficiently close together and erratic movement of said playing piece requiring the players to anticipate the row in which the playing piece will come to rest and to quickly operate the associated actuating member.

8. The playing game of claim 7 further characterized in that said inner element is formed of a material having a greater density than the material forming said outer shell.

9. The playing game of claim 7 further characterized in that said depressions are generally square in shape and said openings are elongate slots which have a length in the longitudinal direction between said two opposed player ends greater then width.

10. The playing game of claim 7 further characterized in that (a) said first playing piece projecting elements are located at each depression in each of the rows and the first playing piece projecting elements being simultaneously operable by the first actuating member associated with such row, (b) said second playing piece projecting elements are located at each depression in each of the rows and the second projecting elements in each row being simultaneously operable by the second actuating member associated with such row, (c) connecting means operatively connecting each of the first projecting elements in each row to the first actuating member associated with each row so that the first projecting elements can extend upwardly through the openings in the depressions upon actuation of the first actuating members associated with said rows to engage and propel a playing piece across the playing board, and (d) connecting means operatively connecting each of the second projecting elements in each row to the second actuating member associated with each row so that the second projecting elements can extend upwardly through the openings in the depressions upon actuation of the second actuating members associated with such rows to engage and propel a playing piece across the playing board.

11. The playing game of claim 10 further characterized in that said first and second projecting elements are located on the respective connecting means, and camming means is provided to bias said connecting means and the projecting elements both upwardly and toward the opposite playing ends.

12. The playing game of claim 1 further characterized in that said game board has a plurality of inclined wall surfaces forming each depression in each row, the inclined wall surfaces forming each depression in each row being sufficiently closely spaced to each other relative to the size of a ball-type playing piece so that said ball-type playing piece will always move along the inclined wall surfaces forming a depression into said depression.

13. The playing game of claim 7 further characterized in that said first and second projecting elements being located in side-by-side relationship at each depression and being individually actuable to initially propel said ball-type playing piece longitudinally across said playing board.

14. A competitive action playing game playable with a shiftable ball-type playing piece, said playing game comprising:

(a) game board having a playing surface extending between a pair of opposed player ends, said game board also having a plurality of longitudinally extending rows of playing piece receiving depression extending from end to end across said playing surface with a plurality of depressions in each such row each of said depressions formed by at least one inwardly sloping wall which opens into an opening at the lower end of each depression, (b) a plurality of first actuating members at the first of the opposed player ends with one first actuating member for each row, (c) a plurality of second actuating members at the second of the opposed player ends with one second actuating member for each such row, (d) an individual first movable playing piece projecting element located at each depression in each of the rows, (e) an individual second movable playing piece projecting element located at each depression in each of the rows (f) an individual first connecting means for each row operatively connecting all of the first projecting elements in such row to an individual first actuating member associated with such row, said first projecting elements in each row normally lying below said playing surface, said first projecting elements in each row being operatively connected to said first connecting means for each such row so that the first projecting elements in such row will generally simultaneously extend upwardly through the openings in the associated depressions and longitudinally toward the second player end upon actuation of said individual first actuating member to engage and propel a ball-type playing piece initially longitudinally across the playing board, said first projecting elements being shiftable to propel said ball-type playing piece generally and at least initially toward the second player end, (g) an individual second connecting means for each row operatively connecting all of the second projecting elements in such row to an individual second actuating member associated with each row, said second projecting elements in each row normally lying below said playing surface, said second projecting elements in each row being operatively connected to said second connecting means for each such row so that the second projecting elements in such row will generally simultaneously extend upwardly through the openings in the associated depressions and longitudinally toward the first player end upon actuation of said individual second actuating member to engage and propel a ball-type playing piece initially longitudinally across the playing board, said second projecting elements being shiftable to propel said ball-type playing piece generally initially toward the first player end, said first and second projecting elements being disposed in side-by-side relationship at each depression in each row, (h) said surface being substantially entirely formed by said depressions so that such ball-type playing piece will always roll into a depression in a particular row, and (i) said ball-type playing piece being comprised of a hollow outer generally spherical shell and an inner element which is freely movable within said outer shell to thereby create a somewhat erratic movement of said playing piece on said playing surface which initially may be longitudinal and which movement may quickly change to a direction which may have a transverse vector component so that the player cannot easily predict the path of movement of the playing piece, said playing piece having a weight relative to the force imposed by the projecting elements in moving the playing piece so that the movement of the playing piece is limited and so that the playing piece is maintained in proximity to said playing surface during movement thereof, the close spacing of the inclined wall portions surrounding the depressions in adjacent rows being sufficiently close together and erratic movement of said playing piece requiring the players to attempt to anticipate the row in which the playing piece will come to rest and to quickly operate the associated actuating member.

15. The playing game of claim 1 further characterized in that said depressions are formed by a plurality of walls such that the depressions are generally square shaped.

16. The playing game of claim 15 further characterized in that the inclined walls forming each depression are triangularly shaped.

17. The playing game of claim 1 further characterized in that the actuating members are shiftable in a direction substantially perpendicular to the movement of the longitudinally shiftable connecting means and the actuating members are rockable to shift the connecting means longitudinally.

18. The playing game of claim 7 further characterized in that the connecting means are longitudinally shiftable connecting arms and each has an upstanding camming projection thereon.

* * * * *

UNITED STATES PATENT OFFICE

CERTIFICATE OF CORRECTION

PATENT NO. : 4,119,315
DATED : October 10, 1978
INVENTOR(S) : Adolph Goldfarb, Erwin Benkoe It is certified that error appears in the above-identified patent and that said Letters Patent are hereby corrected as shown below:

In Claim 1, column 10, line 38, change "alwauys" to --always--;

In Claim 7, column 11, line 47, add a comma after the word "depressions"; and in Claim 18, column 14, line 61, change "claim 7" to --claim 17--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*